US006075250A

United States Patent [19]

Fukui et al.

[11] Patent Number: 6,075,250

[45] Date of Patent: Jun. 13, 2000

[54] RADIATION IMAGE STORAGE PANEL

[75] Inventors: Shinichiro Fukui; Hideki Suzuki, both of Kanagawa, Japan

[73] Assignee: Fuji Photo Film Co., Ltd., Kanagawa, Japan

[21] Appl. No.: 08/917,859

[22] Filed: Aug. 27, 1997

[30] Foreign Application Priority Data

Aug. 27, 1996 [JP] Japan ..... 8-245595
Apr. 14, 1997 [JP] Japan ..... 9-113514

[51] Int. Cl.[7] ..... G21K 4/00
[52] U.S. Cl. ..... 250/484.4
[58] Field of Search ..... 250/484.4

[56] References Cited

U.S. PATENT DOCUMENTS 5,227,253 7/1993 Takasu et al. ..... 428/690
5,483,081 1/1996 Hosoi ..... 250/585

FOREIGN PATENT DOCUMENTS 62-15499 1/1987 Japan ..... 250/484.4
62-247298 10/1987 Japan ..... 250/484.4
2-36400 2/1990 Japan ..... 250/484.4

*Primary Examiner*—Constantine Hannaher
*Attorney, Agent, or Firm*—Birch, Stewart, Kolasch & Birch, LLP

[57] ABSTRACT

A radiation image storage panel has a composite composed of a transparent support and a stimulable phosphor layer, and a protective film is provided both on the surface of the phosphor layer side of the composite and on the back surface of the support. The scratch resistance of the protective film is higher than that of the surface of the support and the contact angle of the protective film is larger than that of the surface of the support. The protective film on the support side surface can comprise a fluororesin and light-scattering particles, and further a titanate- or aluminate-coupling agent.

10 Claims, 2 Drawing Sheets

RADIATION IMAGE STORAGE PANEL

FIELD OF THE INVENTION

The present invention relates to a radiation image storage panel employable in a radiation image recording and reproducing method utilizing a stimulable phosphor.

BACKGROUND THE INVENTION

As a method replacing conventional radiography, a radiation image recording and reproducing method utilizing a stimulable phosphor was proposed and has been practically employed. In the method, a radiation image storage panel comprising a stimulable phosphor (i.e., stimulable phosphor sheet) is employed, and the method comprises the steps of causing the stimulable phosphor of the panel to absorb radiation energy having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (stimulated emission); photoelectrically detecting the light emission to obtain electric signals; and reproducing the radiation image of the object as a visible image from the electric signals. The radiation image storage panel thus treated is subjected to a step for erasing a radiation image remaining therein, and then is stored for the next radiation image recording and reproducing procedure. Thus, the radiation image storage panel can be repeatedly employed.

In the radiation image recording and reproducing method, a radiation image is obtainable with a sufficient amount of information by applying radiation to an object at a considerably smaller dose, as compared with the conventional radiography using a combination of a radiographic film and a radiographic intensifying screen. The radiation image recording and reproducing method using a stimulable phosphor is of great value especially when the method is employed for medical diagnosis.

The radiation image storage panel employed in the above-described method has a basic structure comprising a support and a stimulable phosphor layer provided on one surface of the support. The stimulable phosphor layer generally comprises stimulable phosphor particles and a binder polymer. Further, a transparent film of polymer material is generally provided on the free surface (i.e., surface not facing the support) of the phosphor layer to keep the phosphor layer from chemical deterioration or physical shock.

As well as a phosphor layer comprising a binder and a stimulable phosphor dispersed therein, a phosphor layer formed by deposition process or firing process can be employed.

The radiation image recording and reproducing method can be performed by means of an apparatus comprising: recording means (by which a radiation image is recorded on the panel), reading means (by which the radiation image recorded in the panel is read through the steps of exciting the stimulable phosphor with a stimulating ray to release stimulated emission and photoelectrically detecting the emission to read the recorded image), erasing means (by which the radiation image remaining on the panel is erased with erasing light), and conveying system connecting each means for conveying the panel. In such all-in-one type apparatus, the panel is repeatedly conveyed and repeatedly used. The above means may be separated into a recording apparatus comprising the recording means and a reading apparatus which has the reading means and the erasing means. In such case, the method is performed by a combination of the recording apparatus and the reading apparatus. The radiation image storage panel is repeatedly used in either case.

In the radiation image recording and reproducing method, the radiation image recorded in the storage panel is generally read by applying the stimulating rays onto one surface side of the storage panel and collecting light emitted by the phosphor particles by means of a light-collecting means from the same side. However the light emitted by the phosphor particles may be collected on both sides of the radiation image storage panel. For instance, it may be the case that the emitted light is desired to be collected as much as possible. There also is a case that the radiation image recorded in the phosphor layer varies along the depth of the layer and such variation is desired to be detected. A typical radiation image reading system reading from both sides (hereinafter, referred to as "double-side reading system") is illustrated in the attached FIG. 1.

In the FIG.1, the radiation image storage panel 11 is transferred (or moved) by a combination of two sets of nip rolls 12*a*, 12*b*. The stimulating rays such as laser beam 13 is applied onto the storage panel 11 on one side, and the light emitted by the phosphor particles in the storage panel advances upward and downward (in other words, to both the upper and lower surface sides). The downward advancing light 14*a* is collected by a light collector 15*a* (arranged on the lower side), converted into an electric signal in a photoelectric conversion device (e.g., photomultiplier) 16*a*, multiplied in multiplier 17*a*, and then sent to a signal processor 18. On the other hand, the upwardly advancing light 14*b* is directly, or after reflection on a mirror 19, collected by a light collector 15*b* (arranged on the upper side), converted into an electric signal in a photoelectric conversion device (e.g., photomultiplier) 16*b*, multiplied in multiplier 17*b*, and then sent to a signal processor 18. In the signal processor 18, the electric signals sent from the photoelectric conversion devices 17*a*, 17*b* are processed in a predetermined manner such as addition or reduction of the signals depending on the nature of the desired radiation image.

The radiation image storage panel 11 is further moved by means of two sets of nip rolls 12*a*, 12*b* in the direction indicated by the arrow. The surface area of the panel on which the stimulating rays 13 have been applied is then set under a light source 20 such as a sodium lamp 20 for erasing an radiation image remaining in the storage panel 11.

As is described above, the radiation image storage panel is repeatedly used in the cyclic procedure comprising the steps of exposing to a radiation (for recording of a radiation image), irradiating with stimulating rays (for reading of the recorded image) and exposing to an erasing light (for erasing the remaining image). The storage panel is transferred from one step to another step by means of conveying means such as belt and rolls, and after a cycle of steps is conducted, the panel is piled up on other panels and stored for next cycle.

The radiation image storage panel used in the double-side reading system generally has a phosphor layer whose faces are covered with a transparent support (on the bottom side) and a transparent protective film (provided on the top side). However, the present inventors have found that such panel has a disadvantageous property: that is, the panel having been repeatedly used many times often gives relatively poor radiation images. For example, a ghost image is superimposed on the desired image, or noises have occurred which make the image quality poor.

The inventors have studied the cause of production of poor radiation image and found the mechanism of the deterioration of the radiation image: that is, as the panel is repeatedly used, stains gradually deposit and abrasions are produced on the protective film and the back surface (surface not facing the phosphor layer) of the support, and therefore such stains and abrasions disturbs passages of the emitted light and make the image quality lower.

With respect to the radiation image storage panel used in the single-side reading system, such deterioration is known and several improvements are proposed. In U.S. patent application Ser. No. 08/469,761 for example, the use of a protective film of a resin containing a fluororesin soluble in an organic solvent is proposed. Also proposed is a protective film made of a resin containing a film-forming resin and oligomer having a polysiloxane structure and/or having a perfluoroalkyl group in U.S. Pat. No. 5,227,253. U.S. patent application Ser. No. 08/834,772, now issued as U.S. Pat. No. 5,866,266, describes that a protective composite of a plastic film and a coated film of a fluororesin composition are placed on the phosphor layer.

There is no knowledge, however, about the mechanism of deterioration of the radiation image given by the storage panel having been repeatedly used in the double-side reading system.

SUMMARY OF THE INVENTION

The present invention resides in a radiation image storage panel having a composite comprising a transparent support and a phosphor layer provided thereon containing stimulable phosphor particles, wherein the composite is covered on its both side surfaces (i.e., on the phosphor layer side surface and on the support side surface) with a protective film whose scratch resistance is higher than that of the surface of the support and whose contact angle is larger than that of the surface of the support.

The "contact angle" and "scratch resistance", in the specification are determined by the following measurements:

contact angle: methylene iodide is dropped onto a sample surface, and after 60 seconds the contact angle is measured;

scratch resistance: a sample surface is scratched with a pencil and the scratch value is determined in accordance with JIS (i.e., Japanese industrial Standard).

In the radiation image storage panel of the invention, the thickness of the protective film on the phosphor layer side surface is preferably smaller than that of the protective film on the back surface of the support.

DETAILED DESCRIPTION OF THE INVENTION

Typical examples of the radiation image storage panels of the invention are explained below by referring to the attached drawings.

Figure 1:
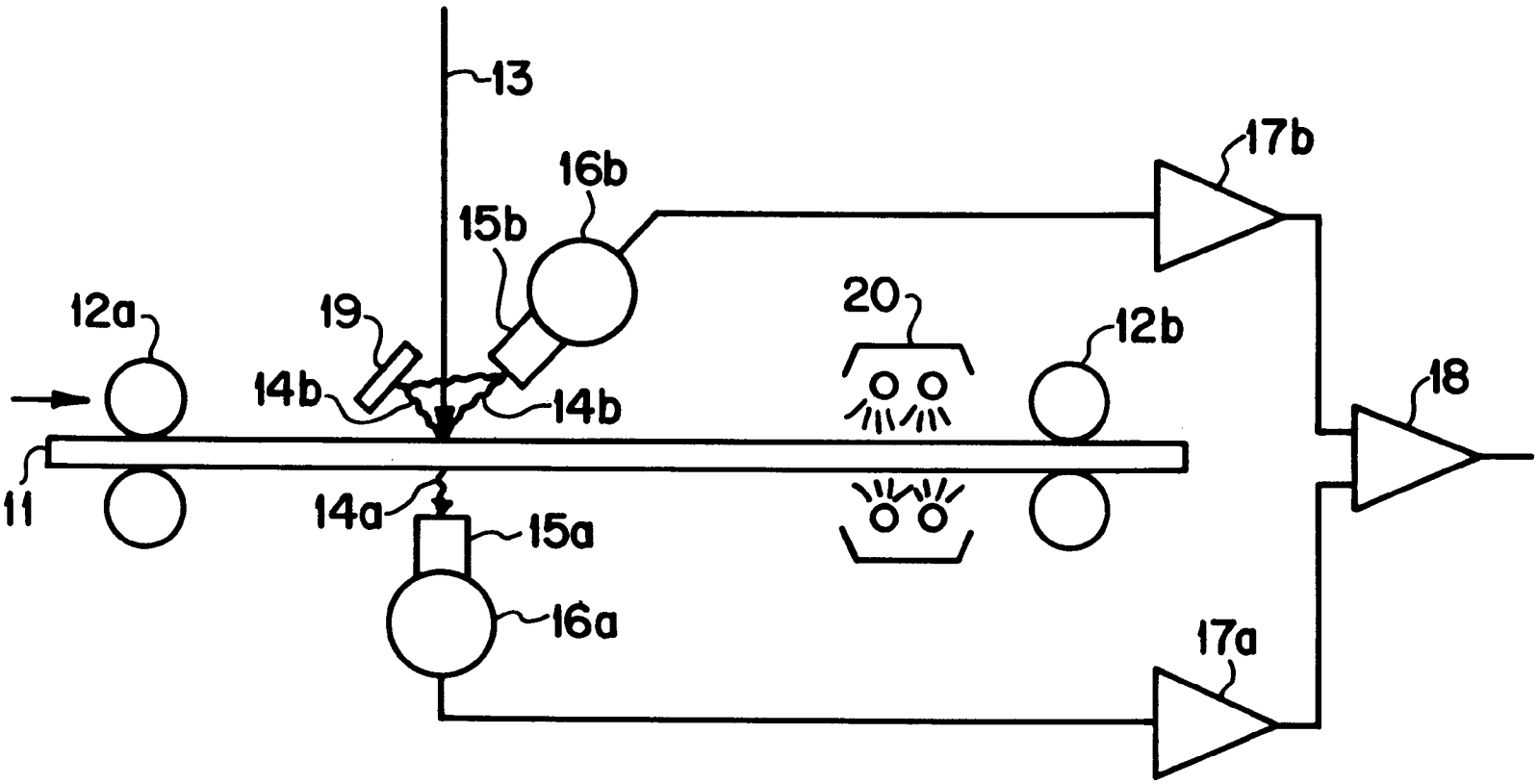
FIG. 1 (PRIOR ART)
FIG. 1 schematically illustrates a radiation image reproducing apparatus which can be used for reproducing a radiation image from a radiation image storage panel according to the double-side reading system.
Figure 2:
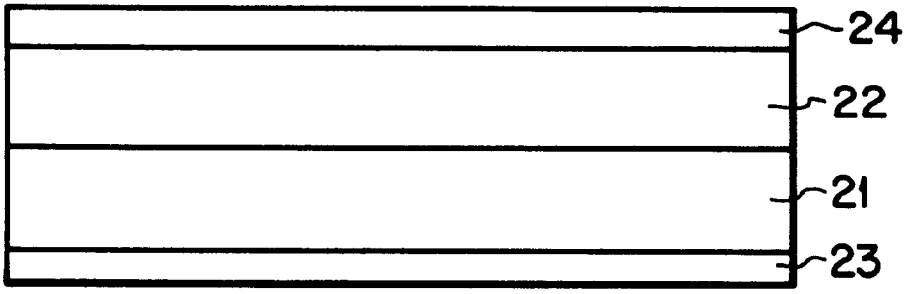
FIG. 2 shows a schematic section of a radiation image storage panel of the invention.

FIG. 2 shows an example of the radiation image storage panel of the invention. The panel comprises a transparent support 21 and a phosphor layer 22 provided thereon containing stimulable phosphor particles, and protective films 23, 24 having a high scratch resistance and a large contact angle are provided on both of the top surface of the phosphor layer 22 and the back (bottom) surface of the support 21. The scratch resistance and the contact angle of the protective films are higher and larger than those on the surface of the support.

Figure 3:
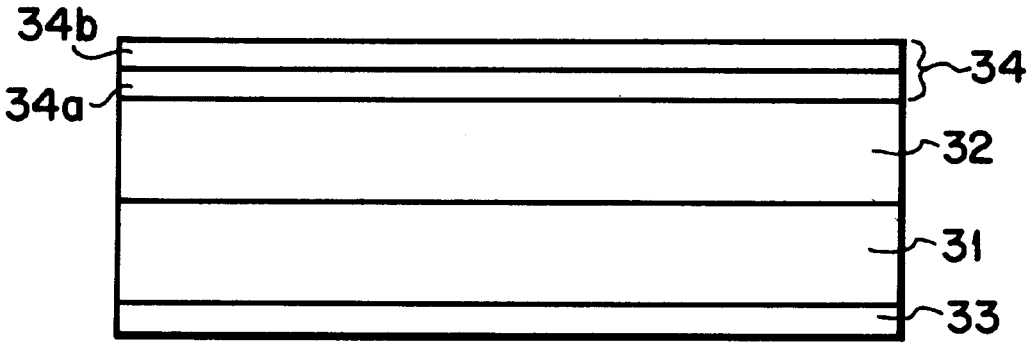
FIG. 3 shows a schematic section of another radiation image storage panel of the invention.

FIG. 3 shows another example of the radiation image storage panel of the invention. The panel comprises a transparent support 31 and a phosphor layer 32 provided thereon containing stimulable phosphor particles, and a protective film 33 having a high scratch resistance and a large contact angle (which are superior to those of the surface of the support 31) is formed on the back (bottom) surface of the support 31. On the other hand, on the phosphor layer 32 there are provided a transparent resin film **34*a* and a protective film 34*b* having a scratch resistance and a contact angle which are higher and larger than those of the surface of the support 31**.

The radiation image storage panel of the invention has a basic structure which comprises a transparent support and a phosphor layer provided thereon, and on both surfaces (i.e., the top surface and the bottom surface) of which protective film having the specific properties is provided.

The radiation image storage panel of the invention can be prepared in the following manner.

As the transparent support of the panel, a transparent plastic film (or sheet) is usually used. The transparent support film can be optionally selected from the known materials employed for the conventional radiation image storage panel. Examples of the known materials include films of plastic materials such as polyethylene terephthalate, polyethylene naphthalate, polyamide and polyimidoamide. Other materials also can be employed, provided that the materials have enough strength and high transparency. The thickness of the transparent support film generally in the range of 10 to 1,000 $\mu$m.

The stimulable phosphor gives a stimulated emission (i.e., light emission) when it is irradiated with stimulating rays after it is exposed to radiation. In the preferred radiation image storage panel, a stimulable phosphor gives a stimulated emission of a wavelength in the range of 300 to 500 nm when it is irradiated with stimulating rays of a wavelength in the range of 400 to 900 nm. Examples of the preferred stimulable phosphors include divalent europium activated alkaline earth metal halide phosphors and a cerium activated alkaline earth metal halide phosphors. Both stimulable phosphors favorably give the stimulated emission of high luminance. However, the stimulable phosphors employable in the radiation image storage panel of the invention are not limited to the above-mentioned preferred stimulable phosphors.

A usual stimulable phosphor layer comprises a binder and stimulable phosphor particles dispersed therein, and the binder can be optionally selected from the known materials employed for the conventional radiation image storage panel.

A stimulable phosphor layer can be formed on the support in the known manner as follows.

The stimulable phosphor and a binder are added to an appropriate solvent, and they are well mixed to prepare a coating dispersion for the formation of a phosphor layer in which the stimulable phosphor particles are homogeneously dispersed in a binder solution. A ratio between the binder and the phosphor in the coating dispersion may be determined according to the characteristics of the desired radiation image storage panel and the nature of the employed phosphor. Generally, the ratio is within the range of from 1:1 to 1:100 (binder:phosphor, by weight), preferably from 1:8 to 1:40. The dispersion thus prepared is coated evenly over the surface of a support to form a coated layer of the dispersion. The coating procedure can be carried out by a conventional method such as a method of using a doctor blade, a roll coater, or a knife coater.

Then the coated layer of the dispersion is dried to form a stimulable phosphor layer on the support. The thickness of the phosphor layer varies depending upon the characteristics of the desired radiation image storage panel, the nature of the phosphor, the ratio between the binder and the phosphor, etc. Generally, the thickness of the phosphor layer is in the range of 20 $\mu$m to 1 mm, preferably in the range of 50 to 500 $\mu$m.

The phosphor layer can be provided on the support a method other than that given in the above. For example, the phosphor layer is initially prepared on a sheet (i.e., temporary support) such as a glass plate, metal plate or plastic sheet using the aforementioned coating dispersion and thus prepared phosphor layer is then placed on the genuine support by pressing or using an adhesive agent.

For the stimulable phosphor layer of the radiation image storage panel of the invention, not only a phosphor layer comprising a binder and a stimulable phosphor dispersed therein but also a phosphor layer composed of only an agglomerate of a stimulable phosphor containing no binder can be also employable. Also employable is a phosphor layer in which voids of stimulable phosphor agglomerate are impregnated with a polymer material.

In the above-described manner, a composite body comprising the phosphor layer and the transparent support can be prepared. The radiation image storage panel of the invention is characterized by providing the specific protective film on both surfaces (i.e., the top surface and the bottom surface) of the composite body, and the protective film has a higher scratch resistance and a larger contact angle, as compared with those of the surface of the support. Since the protective film has a high scratch resistance and a high anti-staining property, the storage panel of the invention is hardly stained and the stains on the panel are easily removed out with an organic solvent.

The protective film of the invention is preferably made of a fluororesin alone or a resin composition mainly containing a fluororesin. The protective film may comprise a transparent film and a protective layer provided thereon which is made of a fluororesin alone or a resin composition mainly containing fluororesin.

A preferred protective film of the invention can be produced in the following manner: a coating liquid (in the form of dispersion or solution) for the formation of the protective film is prepared by adding a film-forming resin composition (such as a fluororesin alone, a fluororesin and other film-forming resins, or a fluororesin and oligomer having a polysiloxane structure and/or having a perfluoroalkyl group) to an appropriate solvent, and the liquid mixture thus prepared is coated evenly on the back surface of a support and the surface of the phosphor layer by means of coating means such as a doctor blade, and then the coated layer of the liquid is dried to form the protective film.

The protective film may be made in advance of forming the composite body comprising the support and the phosphor layer. For instance, the radiation image storage panel of the invention can be also produced in the following manner: a protective film is beforehand formed by coating the above-described coating liquid on one surface of the support, and independently another protective film is beforehand formed in the same manner on the surface of the phosphor sheet, and then the support and the phosphor sheet are combined to give the radiation image storage panel.

The film-forming resins employable for forming the protective film in conjunction with the fluororesin are selected from known materials such as polyurethane resin, polyacryl resin, cellulose derivatives, polymethyl methacrylate, polyester resin and epoxy resin.

The fluororesin can be a homopolymer of a fluorine atom-containing olefin or a copolymer of fluorine atomcontaining olefin and one or more other monomers. Examples of the fluororesins include polytetrafluoroethylene, polychlorotrifluoroethylene, polyfluorinated vinyl, polyfluorinated vinylidene, tetrafluoroethylene-hexafluoropropylene copolymer, and fluoroolefin-vinyl ether copolymer. Most of the fluororesins are insoluble in organic solvents. However, copolymers of the fluoroolefin and other polymerizable monomer can be made soluble in a certain organic solvent if an appropriate monomer is combined. Therefore, such soluble fluororesins can be dissolved in an appropriate organic solvent to prepare a coating solution, and thus prepared coating solution can be applied on the support or on the phosphor layer and dried to form a protective film containing the fluororesin. Examples of such soluble fluororesin copolymer include fluoroolefin-vinyl ether copolymer. Besides fluoroolefin-vinyl ether copolymer, tetrafluoroethylene and its modified polymer are also employable because they are soluble in fluorine atom-containing organic solvents such as a perfluoro solvent.

The film-forming composition may contain a crosslinking agent, a hardening agent and an anti-yellowing agent. If a fluororesin is employed for forming the protective film, the fluororesin is preferably crosslinked to increase strength and durability of the film. Examples of the preferred crosslinking agents include a compound having a plural number of isocyanate groups (e.g., polyisocyanate) and melamine derivatives.

The oligomer having polysiloxane structure employable for forming the protective film with the fluororesin is, for example, an oligomer having dimethylpolysiloxane structure. The oligomer preferably has at least one functional group (e.g., hydroxyl group), and the molecular weight preferably is in the range of 500 to 100,000 (weight average), more preferably 1,000 to 100,000 and particularly preferably 3,000 to 100,000. The oligomer having a perfluoroalkyl group (e.g., tetrafluoroethylene group) preferably has at least one functional group (such as hydroxyl group), and the molecular weight is preferably in a range of 500 to 100,000 (weight average), more preferably 1,000 to 100,000 and particularly preferably 3,000 to 100,000.

The oligomer having functional group is preferably employed for forming the protective film. Such oligomer is incorporated into the molecular structure of the film-forming resin comprising a fluororesin during the crosslinking reaction between the oligomer and the resin for the formation of the protective film, and therefore the oligomer is hardly removed by cleaning the film surface with an organic solvent or by repeated use of the radiation image storage panel for a long period. Accordingly, the effect of the incorporation of the oligomer continues for long time. The film-forming composition comprising a fluororesin contains the above oligomer preferably in an amount of 0.01–10 wt. %, more preferably 0.1–2 wt. %.

The film-forming composition may contain a perfluoroolefin resin powder or a silicone resin powder. The mean particle size of the powder is preferably in a range of 0.1 to 10 μm, more preferably 0.3 to 5 μm. The amount of the powder is preferably in a range of 0.5 to 30 wt. %, more preferably 2 to 20 wt. %, and further preferably 5 to 15 wt. %.

The protective film, particularly the protective film on the transparent support side, preferably comprise a fluororesin and light-scattering particles. The protective film preferably further contains a dispersing agent such as a coupling agent of a titanate type or an aluminate type. The light-scattering particles preferably contains in an amount of 1 to 30 weight % (more preferably 5 to 20 weight %, most preferably 10 to 20 weight %) in the fluororesin-containing protective layer.

The light-scattering particles preferably have a mean particle size smaller than the thickness of the protective layer into which the particles are incorporated. For instance, the light-scattering particles preferably have a mean particle size of 0.05 to 5 μm, particularly 0.1 to 1.0 μm. The light-scattering particles preferably a refractive index higher than that of the fluororesin or a mixture of a fluroresin and other polymers in the protective layer, so that effective light-scattering proprerty is introduced into the protective layer. In view of the advantageous high light-scattering property provided by the incorporated light-scattering property and disadvantageous features such as decrease of strength of the coated film and decrease of uniformity of the protective film, the light-scattering particles are preferably incorporated into the fluororesin-containing protective layer in an amount of 1 to 30 weight %, more particularly 5 to 20 weight %, most preferably 10 to 20 weight %.

There are no specific limitations with respect to the light-scattering particles incorporated into the protective layer, so long as the particles have a refractive index higher than that of the fluororesin or a mixture of the fluororesin and other polymers employed for the preparation of the protective layer. Organic fine particles and inorganic fine particles are both employable. Examples of the preferred light-scattering particles include benzoquanamine resin particles having a mean particle size of 0.1 to 0.5 μm, melamine-formaldehyde condensation resin particles having a mean particle size of 0.1 to 0.5 μm, and titanium dioxide particles having a mean particle size of 0.1 to 0.5 μm.

It is preferred that the light-scattering particles are uniformly dispersed in the fluororesin-containing protective layer. Therefore, the light-scattering particles are preferably treated on their surfaces so as to improved dispersibility. Otherwise, a dispersing agent is incorporated into a coating solution containing the fluororesin or a mixture of the fluororesin and other polymers and the light-scattering particles. Examples of the employable dispersing agents include cationic dispersants, anionic dispersants, nonionic dispersants, and amphoteric dispersants (e.g., betaine-type surfactants). Also employable are coupling agent-type dispersants such as silane-coupling agents, titanate-coupling agents, and aluminum-coupling agents. The titanate-coupling agents and the aluminum-coupling agents are most preferred. The coupling agent is preferably incorporated into the protective layer in an amount of 0.5 to 5.0 weight %, based on the amount of the light-scattering particles.

As is described above, the protective film may comprise a transparent film and a protective layer provided thereon. The transparent film can be optionally selected from those known as a protective film of the conventional radiation image storage panel, for instance, films of polyethylene terephthalate, polyethylene naphthalate, polyamide, polycarbonate, polyvinylidene chloride, polyimide and aramide. Other plastic materials also can be employed, provided that the plastic materials have enough strength and high transparency. The thickness of the transparent film of plastic material generally ranges from 1 to 10 μm.

EXAMPLE 1

The radiation image storage panel of the invention was prepared in the following manner.

(1) 200 g of a stirnulable phosphor ($BaFBr_{0.9}I_{0.1}$:0.001$Eu^{2+}$), 8 g of a polyurethane elastomer (Pandex T-5265H, product of Dai-Nippon Ink Chemical Industries Co., Ltd.) and 2 g of an epoxy resin (Epikote 1001, product of Yuka Shell Epoxy Co., Ltd.) were placed in methyl ethyl ketone and dispersed by means of a propeller mixer to give a coating dispersion of a viscosity of 25–30 PS (at 25° C.). The coating dispersion was coated on a polyethylene terephthalate temporary support having silicone release coating. After the coated layer was dried at 100° C. for 15 minutes, the dried layer was peeled from the temporary support to prepare a stimulable phosphor sheet having a thickness of 300 μm.

(2) 70 g of a fluororesin (fluoroolefin-monovinyl ether copolymer: Lumiflon LF504X, product of Asahi Glass Co., Ltd.), 12 g of an isocyanate crosslinking agent (Olestar NP38-70S, product of Mitsui Toatsu Chemicals, Inc.), 0.55 g of a lubricant (silicone resin: X-22-2809, product of The Shin-Etsu Chemical Co., Ltd.) and 0.0004 g of a catalyst (dibutyltin laurate, KS-1260, product of Kyodo Yakuhin Co., Ltd.) were dissolved in a mixture of methyl ethyl ketone and cyclohexane to prepare a coating solution containing the resin in an amount of 14 wt. %, and then the viscosity of coating solution was adjusted to 2–3 PS. The prepared solution was then coated and dried on a polyethylene terephthalate film (thickness: 300 μm) to give a dry coated layer of 7 μm thick. Thus, a transparent support having a protective film on one side was produced.

The scratch resistance and the contact angle of the surface of the protective film provided on the support (polyethylene terephthalate film) and those of the unprotected surface of the same support were measured in the following manner;

contact angle: methylene iodide was dropped onto the sample surface, and after 60 seconds the value of the contact angle was measured;

scratch resistance: the sample surface was scratched with a pencil and the scratch value was determined in accordance with JIS (Japanese Industrial Standard).

The results are as follows:

surface of the protective film:

contact angle: 75°, scratch resistance: 3B unprotected surface of the same support:

contact angle: 32°, scratch resistance: 4B.

(3) The phosphor sheet prepared in the above procedure (1) was overlaid on the other surface (on which the protective film was not provided) of the support of (2) via an adhesive agent, and then pressed and heated at 60–70° C. by means of a heating roll. Thus, a phosphor layer (thickness: 200 μm) was provided, via a subbing layer, on the support having protective film was obtained.

(4) A transparent polyethylene terephthalate film (thickness: 6 μm, having an adhesive layer of a polyester adhesive agent on one surface) was overlaid on the above phosphor layer under the condition that the adhesive layer was brought into contact with the phosphor sheet, and then pressed and heated at 90–100° C. by means of a heating roll.

Independently, 50 g of 50 wt. % xylene solution of a fluororesin (fluoroolefin-vinyl ether copolymer: Lumiflon LF100, product of Asahi Glass Co., Ltd.), 5 g of an isocyanate crosslinking agent (Colonate HX, solid content 100 wt. %, product of Nippon Polyurethane Co., Ltd.) and 0.5 g of an alcohol-modified silicone oligomer (X-22-2809, solid content 66 wt. %, product of Shin-Etsu Chemical Co., Ltd., which had dimethylpolysiloxane structure and had hydroxyl groups (carbinol groups) in both terminals), were dissolved in methyl ethyl ketone to prepare a coating solution (viscosity: 0.1–0.3 PS). The prepared coating solution was coated on the above polyethylene terephthalate film provided on the phosphor layer by means of a doctor blade, and then heated and dried to cure at 120° C. for 20 minutes to prepare a protective layer (thickness: about 2 μm) on the transparent film.

Thus, a radiation image storage panel of the invention was prepared.

EXAMPLE 2

The procedure of Example 1 was repeated, except for preparing the protective film on the support in the following manner, to produce a radiation image storage panel of the invention.

70 g of a fluororesin (fluoroolefin-monovinyl ether copolymer: Lumiflon LF504X, product of Asahi Glass Co., Ltd.), 7 g of a melamine crosslinking agent (Cymel 303, product of Mitsui Cytec Co., Ltd.), 0.55 g of a lubricant (silicone resin: X-22-2809, product of The Shin-Etsu Chemical Co., Ltd.) and 0.5 g of a catalyst (Catalyst 4040, product of Mitsui Cytec Co., Ltd.) were dissolved in a mixture of methyl ethyl ketone and cyclohexane to prepare a coating solution containing the resin in an amount of 18 wt. %, and then a viscosity of the coating solution was adjusted to 2–3 PS. The prepared solution was then coated and dried on a polyethylene terephthalate film (thickness: 300 μm) to give a dried layer of 10 μm thick. Thus, a transparent support having a protective film on one surface was provided.

The scratch resistance and the contact angle of the surface of the protective film provided on the support (polyethylene terephthalate film) and those of the unprotected surface of the same support were measured in the manner as in Example 1.

The results are as follows:

surface of the protective film:

contact angle: 78°, scratch resistance: 3B unprotected surface of the same support:

contact angle: 32°, scratch resistance: 4B.

EXAMPLE 3

The procedure of Example 1 was repeated, except for preparing the protective film on the support in the following manner, to produce a radiation image storage panel of the invention.

70 g of a fluororesin (fluoroolefin-monovinyl ether copolymer: Lumiflon LF504X, product of Asahi Glass Co., Ltd.), 5.2 g of an isocyanate cross-linking agent (Sumijule N3500, product of Sumitomo Bayer Urethane Co., Ltd.), 6.7 g of a lubricant (silicone resin: X-22-2809, product of The Shin-Etsu Chemical Co., Ltd.), 0.3 g of a catalyst (dibutyltin laurate, KS-1260, product of Kyodo Yakuhin Co., Ltd.), melamine-formaldehyde condensation resin particles (mean diameter: 0.6 μm, refractive index: 1.57, Eposter S-6, product of Nihon Catalyst Co., Ltd.), and 0.12 g of a titanate-coupling agent (Prenact AL-M, product of Azinomoto Co., Ltd.) were dissolved or dispersed in a mixture of methyl ethyl ketone and cyclohexane to prepare a coating solution containing the resin in an amount of 12 wt. %. The prepared solution was then coated and dried on a polyethylene terephthalate film (thickness: 300 μm) to give a dried layer of 7 μm thick. Thus, a transparent support having a protective film on one surface was provided. The resin composition comprising the fluororesin and other binder compositions had a refractive index of 1.45.

The scratch resistance and the contact angle of the surface of the protective film provided on the support (polyethylene terephthalate film) and those of the unprotected surface of the same support were measured in the manner as in Example 1.

The results are as follows:

surface of the protective film:

contact angle: 67°, scratch resistance: 3B unprotected surface of the same support:

contact angle: 32°, scratch resistance: 4B.

EXAMPLE 4

The procedure of Example 1 was repeated, except for preparing the protective film on the support in the following manner, to produce a radiation image storage panel of the invention.

70 g of a fluororesin (fluoroolefin-monovinyl ether copolymer: Lumiflon LF504X, product of Asahi Glass Co., Ltd.), 7 g of a melamine crosslinking agent (Cymel 303, product of Mitsui Cytec Co., Ltd.), 6.7 g of a lubricant (silicone resin: X-22-2809, product of The Shin-Etsu Chemical Co., Ltd.), 6.62 g of melamine-formaldehyde condensation resin particles (mean diameter: 0.6 μm, refractive index: 1.57, Eposter S-6, product of Nihon Catalyst Co., Ltd.), 0.12 g of a titanate-coupling agent (Prenact AL-M, pro-duct of Azinomoto Co., Ltd.), and 0.5 g of a catalyst (Catalyst 4040, product of Mitsui Cytec Co., Ltd.) were dissolved or dispersed in a mixture of methyl ethyl ketone and cyclohexane to prepare a coating solution containing the resin in an amount of 12 wt. %. The prepared solution was then coated and dried on a polyethylene terephthalate film (thickness: 300 μm) to give a dried layer of 7 μm thick. Thus, a transparent support having a protective film on one surface was provided. The resin composition comprising the fluororesin and other binder compositions had a refractive index of 1.45.

The scratch resistance and the contact angle of the surface of the protective film provided on the support (polyethylene terephthalate film) and those of the unprotected surface of the same support were measured in the manner as in Example 1.

The results are as follows:

surface of the protective film:

contact angle: 70°, scratch resistance: 3B unprotected surface of the same support:

contact angle: 32°, scratch resistance: 4B.

COMPARISION EXAMPLE 1

The procedure of Example 1 was repeated except for not providing the protective film on the support to produce a radiation image storage panel for comparison.

Evaluation of Radiation Image Storage Panel

The scratch resistance and the anti-staining property of the panels of Examples 1 and 2 and Comparison Example 1 were evaluated by the following tests.

(1) Durability test for conveying

The radiation image storage panel was cut to prepare a rectangular sample piece (100 mm×250 mm), and then the sample piece was subjected to a durability test for conveying in a model conveying system (a miniature of conveying system of a commercially available radiation image recording and reproducing apparatus). The durability test was carried out by repeating a series of procedures consisting of: conveying the sample piece between a guide plate and nip rolls, bending by force once upward and then downward around a rubber roll (diameter: 40 mm) by a conveying belt, and then conveying back between the guide plate and nip rolls to the initial position. After those procedures were repeated 3,000 times, cracks occurring on the protective film of the sample were observed. If there was no crack on the film, the same procedures were further repeated another 7,000 times and then cracks were observed. The results are shown in Table 1.

(2) Deterioration Test of Sensitivity

X-rays were imagewise applied on the radiation image storage panel having been subjected to the above durability test (the procedures had been repeated 3,000 times), and the storage panel was scanned with He—Ne laser beam to stimulate the phosphor. Light emitted from the phosphor was detected from both the upper and the lower surface sides to obtain image data. According to the obtained data, sensitivity (an amount of stimulated emission) of the area having been in contact with parts of the conveying system (belt, rolls, etc.,) was calculated to evaluate deterioration by conveying procedures. The results are shown in Table 1.

TABLE 1

| | conveying durability (cracks on the film) | sensitivity decrease |
|---|---|---|
| Ex. 1 | not observed (after 4,000 times procedures) | 0% |
| Ex. 2 | not observed (after 4,000 times procedures) | 0% |
| Ex. 3 | not observed (after 4,000 times procedures) | 0% |
| Ex. 4 | not observed (after 4,000 times procedures) | 0% |
| Comp. Ex. 1 | observed (after 2,000 times procedures) | 3% |

What is claimed is:

1. A radiation image storage panel having a composite comprising a transparent support of plastic film and a phosphor layer provided thereon containing stimulable phosphor particles, wherein the composite is covered on its top surface and back surface of said support with a protective film comprising a fluororesin whose scratch resistance is higher than that of the surface of the support and whose contact angle is larger than that of the surface of the support.

2. The radiation image storage panel of claim 1, wherein the thickness of the protective film on the phosphor layer side surface is thinner than that of the film on the support side surface.

3. The radiation image storage panel of claim 1, wherein the transparent support comprises plastic material selected from the group consisting of polyethylene terephthalate, polyethylene napthalate, polyamide and polyimidoamide.

4. The radiation image storage panel of claim 1, wherein the fluororesin is selected from the group consisting of polytetrafluoroethylene, polychlorotrifluoroethylene, polyfluorinated vinyl, polyfluorinated vinylidene, tetrafluoroethylene-hexafluoropropylene copolymer, and fluoroolefin-vinyl ether copolymer.

5. The radiation image storage panel of claim 1, wherein the protective film on the support side surface is formed by applying an organic solution of fluororesin directly onto the support side surface.

6. The radiation image storage panel of claim 1, wherein the protective film on the support side surface comprises a fluororesin and light-scattering particles.

7. The radiation image storage panel of claim 1, wherein the protective film on the support side surface comprises a fluororesin, light-scattering particles, and at least one coupling agent selected from the group of a titanate coupling agent and an aluminum coupling agent.

8. The radiation image storage panel of claim 1, wherein the protective film on the phosphor layer side surface is formed by applying an organic solution of fluororesin directly onto the surface of the phosphor layer.

9. The radiation image storage panel of claim 1, wherein the protective film on the phosphor layer side surface is composed of a transparent film and a protective layer provided thereon which is formed by coating a organic solution of fluororesin on the transparent film.

10. The radiation image storage panel of claim 1, wherein the storage panel is for double-side reading system radiation image recording and reproducing method.

* * * * *